US012208864B2

(12) United States Patent
Sevy et al.

(10) Patent No.: US 12,208,864 B2
(45) Date of Patent: Jan. 28, 2025

(54) RETRACTABLE BOAT AWNING

(71) Applicants: Eric C. Sevy, Midvale, UT (US); Mark Peterson, Midvale, UT (US)

(72) Inventors: Eric C. Sevy, Midvale, UT (US); Mark Peterson, Midvale, UT (US)

(73) Assignee: SugarHouse Industries Inc., Midvale, UT (US)

( * ) Notice: Subject to any disclaimer, the term of this patent is extended or adjusted under 35 U.S.C. 154(b) by 484 days.

(21) Appl. No.: 17/692,074

(22) Filed: Mar. 10, 2022

(65) Prior Publication Data

US 2022/0289339 A1 Sep. 15, 2022

Related U.S. Application Data

(60) Provisional application No. 63/160,598, filed on Mar. 12, 2021.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS 7,895,964 B2 * 3/2011 Russikoff ..... B63B 17/02 114/361
11,851,137 B2 * 12/2023 Cao ..... B63B 17/02

* cited by examiner

*Primary Examiner* — Lars A Olson
(74) *Attorney, Agent, or Firm* — Justin Lampel

(57) ABSTRACT

A retractable boat awning or "bimini cover" is provided. The present retractable boat awning may replace existing awnings on a boat or may be added to a boat which lacks an awning. The present retractable boat awning has a first folding locking bar and a second folding locking bar which are concealed within a slim securing container when the device is not in use. To use the awning, the first and the second locking bar are rotated outward from the interior of the securing container and secure a protective awning fabric cover. The awning may be fully assembled into the usable form or may be collapsed into the stored securing container in around a minute.

24 Claims, 8 Drawing Sheets

RETRACTABLE BOAT AWNING

CROSS REFERENCE TO RELATED APPLICATIONS

The following application is a based on and claims the priority benefit of U.S. provisional application Ser. No. 63/160,598 filed Mar. 12, 2021; the entire content of which is incorporated by reference.

BACKGROUND OF THE INVENTION

A retractable boat awning or "bimini cover" is provided. The present retractable boat awning may replace existing awnings on a boat or may be added to a boat which lacks an awning. The present retractable boat awning has a first folding locking bar and a second folding locking bar which are concealed within a slim securing container when the device is not in use. To use the awning, the first and the second locking bar are rotated outward from the interior of the securing container and secure a protective awning fabric cover. The awning may be fully assembled into the usable form or may be collapsed into the stored securing container in around a minute.

Boat awnings are common. For example, U.S. Pat. No. 9,862,461 to Cao discloses an awning for a boat which is operable between retracted and extended positions and includes a frame structure having left and right telescopically extendable and retractable tube assemblies each having a fixed tube, a telescopic mid tube and a telescopic end tube. Cross tubes extend transversely between each of the mid tubes and the end tubes. A canvas roller is mounted transversely between the fixed tubes. A sheet of marine canvas is secured to the roller and the end cross tube and is rolled onto the roller when the awning is retracted. A gear box disengages the canvas roller to allow the telescoping tube assemblies and canvas to be manually extended. To retract the awning, the gear box is engaged with the canvas roller and a removable crank handle is operated to rotate the roller and roll up the canvas as the frame structure is telescopically retracted.

Further, U.S. Pat. No. 7,895,964 to Russikoff discloses a retractable boat top device having an arched canopy assembly operatively deployed in mounted attachment upon a conventional radar arch or like elevated structure on the deck of a boat. The arched canopy assembly includes a stationery roof section formed having a curved planar surface transversely mounted within the radar arch, a pair of telescoping extension arms mounted on opposite sides of the roof section, and an arched roller assembled to hold a flexible canopy material thereon and operatively connected between the outer ends of the extension arms so that the flexible canopy material may be extended and retracted relative to the stationery roof section in an arched configuration substantially in the same plane as the roof section. The arched roller includes a curved roller bar supported coaxially within the bore of a flexible hose member that supports the canopy material in a rolled-up state and further includes torsion spring members mounted along opposite sides of the roller bar to maintain tension upon the canopy material during roll-out and retraction.

Still further, U.S. Pat. No. 7,395,744 to Borges discloses a retractable canopy structure adapted to be used in conjunction with the canopy structure on a boat's existing T-top tubular frame near the level of the existing canopy. The canopy frame structure comprises two longitudinally aligned, telescoping members with at least one transverse, telescoping frame member disposed between the two longitudinal members to prevent the canopy from collapsing when under tension. The canopy frame structure is disposed onto the existing T-top frame using a mounting assembly comprising of a grommet adapted to be placed between two frame members and wrapped with an adjustable strap. The canopy and telescoping frame components are designed to be adaptable to various T-top canopy widths, and can be extended to various lengths to increase the amount of available canopy shade area while in the mounted position on the boat's existing T-top.

However, these patents fail to describe a retractable boat awning which is easy to use. Further, these patents fail to provide for a retractable boat awning which has an extendable first and second locking bar which are concealed in a zipped-up slim securing container when the awning is not in use.

SUMMARY OF THE INVENTION

A retractable boat awning or "bimini cover" is provided. The present retractable boat awning may replace existing awnings on a boat or may be added to a boat which lacks an awning. The present retractable boat awning has a first folding locking bar and a second folding locking bar which are concealed within a slim securing container when the device is not in use. To use the awning, the first and the second locking bar are rotated outward from the interior of the securing container and secure a protective awning fabric cover. The awning may be fully assembled into the usable form or may be collapsed into the stored securing container in around a minute.

An advantage of the present retractable boat awning is that the present retractable boat awning is quickly assembled and quickly stored in a securing container.

Another advantage of the present retractable boat awning is that the present retractable boat awning is lightweight.

Yet another advantage of the present retractable boat awning is that the present retractable boat awning is durable.

For a more complete understanding of the above listed features and advantages of the retractable boat awning reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A retractable boat awning or "bimini cover" is provided. The present retractable boat awning may replace existing awnings on a boat or may be added to a boat which lacks an awning. The present retractable boat awning has a first folding locking bar and a second folding locking bar which are concealed within a slim securing container when the device is not in use. To use the awning, the first and the second locking bar are rotated outward from the interior of the securing container and secure a protective awning fabric cover. The awning may be fully assembled into the usable form or may be collapsed into the stored securing container in around a minute.

Figure 3:
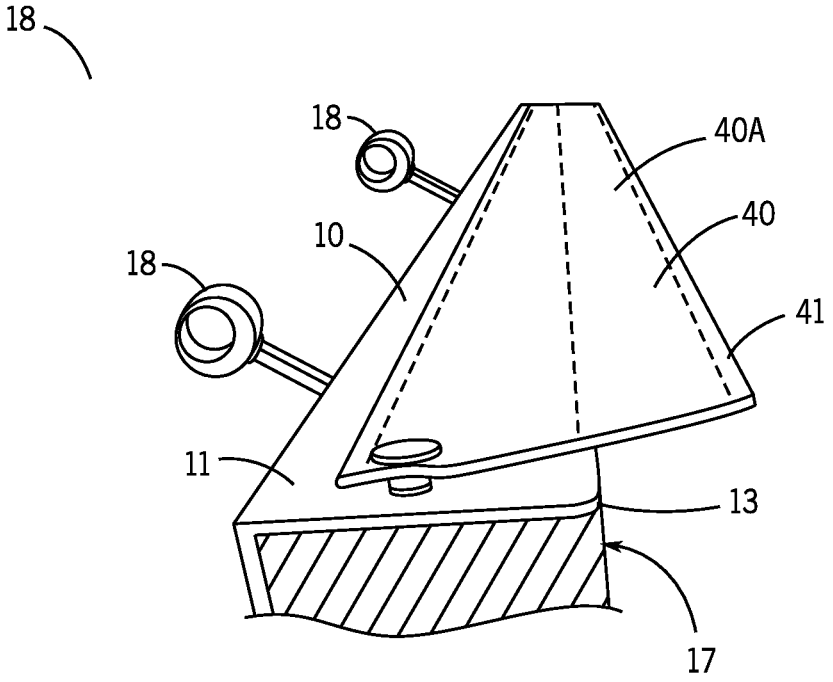
FIG. 3 illustrates a side view of the top and the side of the securing container wherein the securing container is open.
Figure 4:
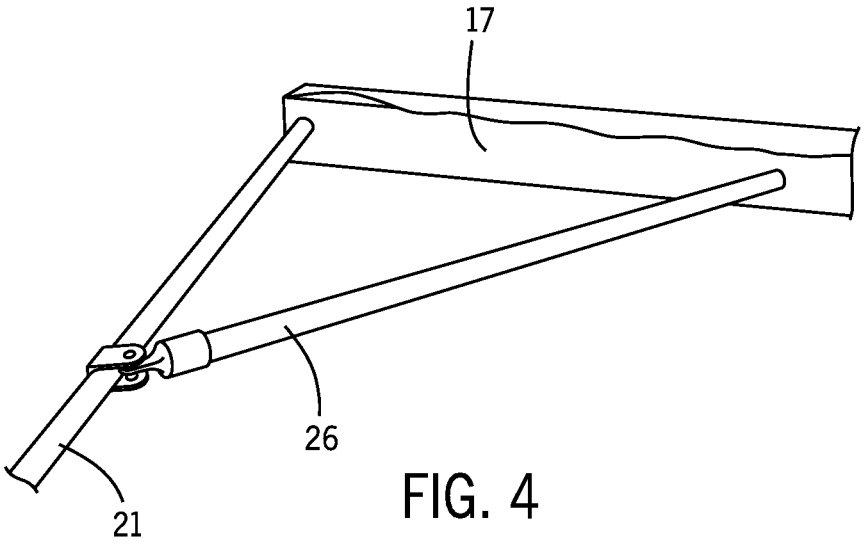
FIG. 4 illustrates a side view of the underside of the awning in the open orientation.

In an embodiment, a retractable awning system 1 for a boat 300 is provided. The retractable awning system 1 may have a slim securing container 10 which secures components of the system within an interior 17 of the container 10. The securing container 10 may have a top 11 (FIG. 3), a bottom 12 (FIG. 1), a front 13 (FIG. 6), a back 14 (FIG. 1), a first side 15 (FIG. 6), a second side 16 (FIG. 11) and an elongated hollow interior 17 (FIG. 3). The slim securing container 10 is generally rectangular, extending approximately the width of the boat 300 that the awning system 1 is used on.

The securing container 10 is preferably made of a lightweight durable material, such as a non-corrosive metal such as, for example, aluminum. The securing container 10 may store at least an awning 20, a first locking bar 21 and a second locking bar 22 within its interior 17 when the awning system 1 is not in use. The awning 20 itself is preferably a durable, flexible fabric material.

Figure 1:
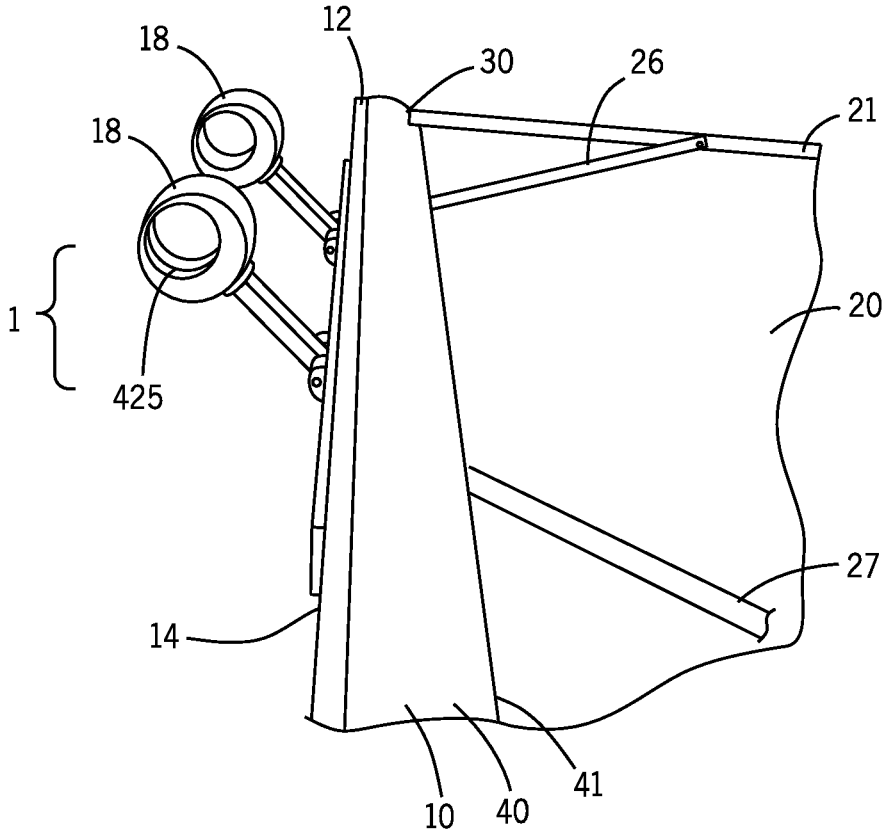
FIG. 1 is a perspective view of the side of the underside of the awning in the open (or "second") orientation.
Figure 2:
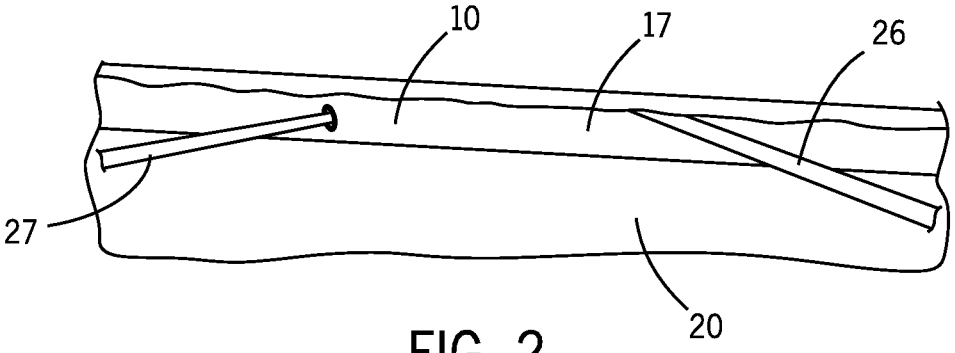
FIG. 2 illustrates the underside of the awning in the open orientation.
Figure 6:
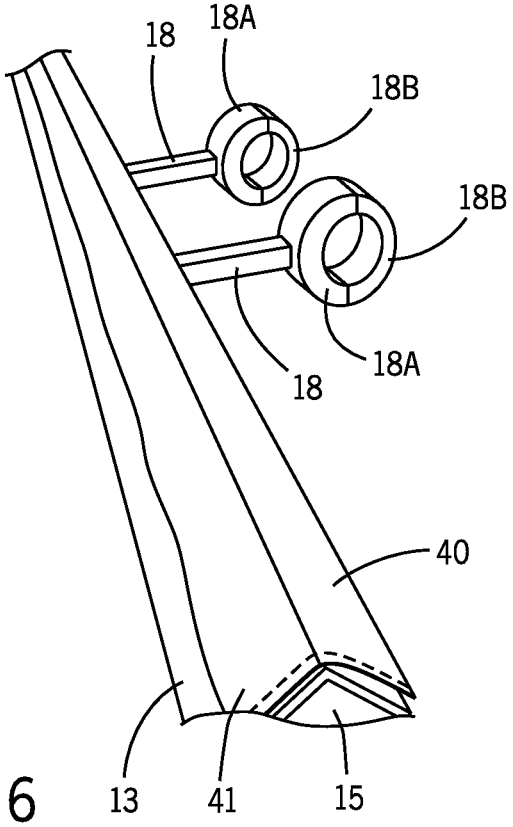
FIG. 6 illustrates a perspective view of the awning in the closed (or "first") orientation.
Figure 7:
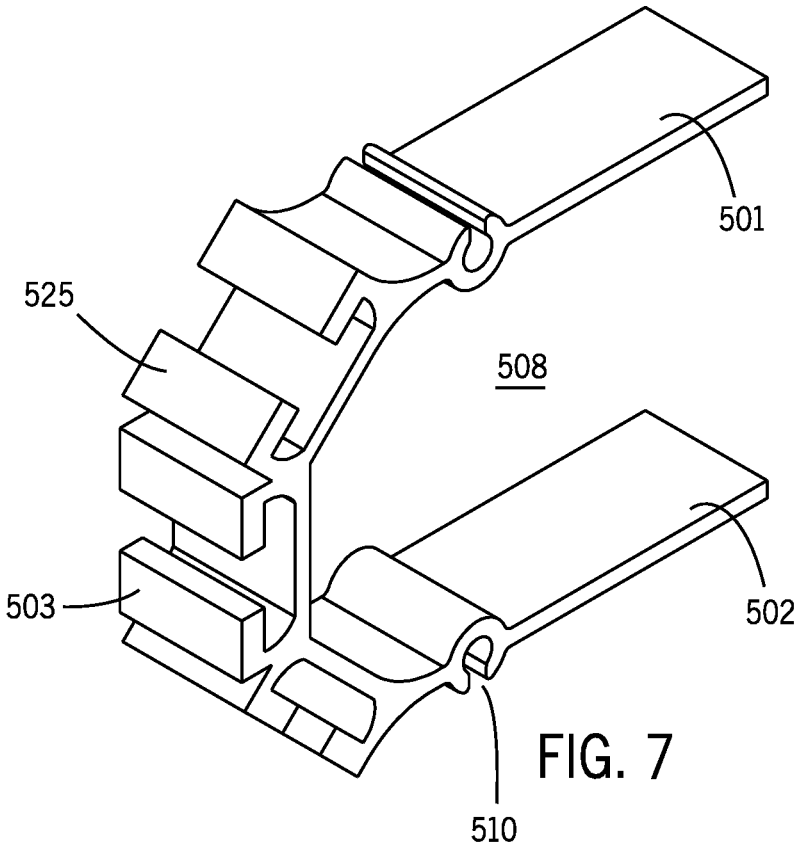
FIG. 7 illustrates a perspective view of an alternative clamp system for the securing container of the awning wherein an adjustable stand-off brace is used.
Figure 8:
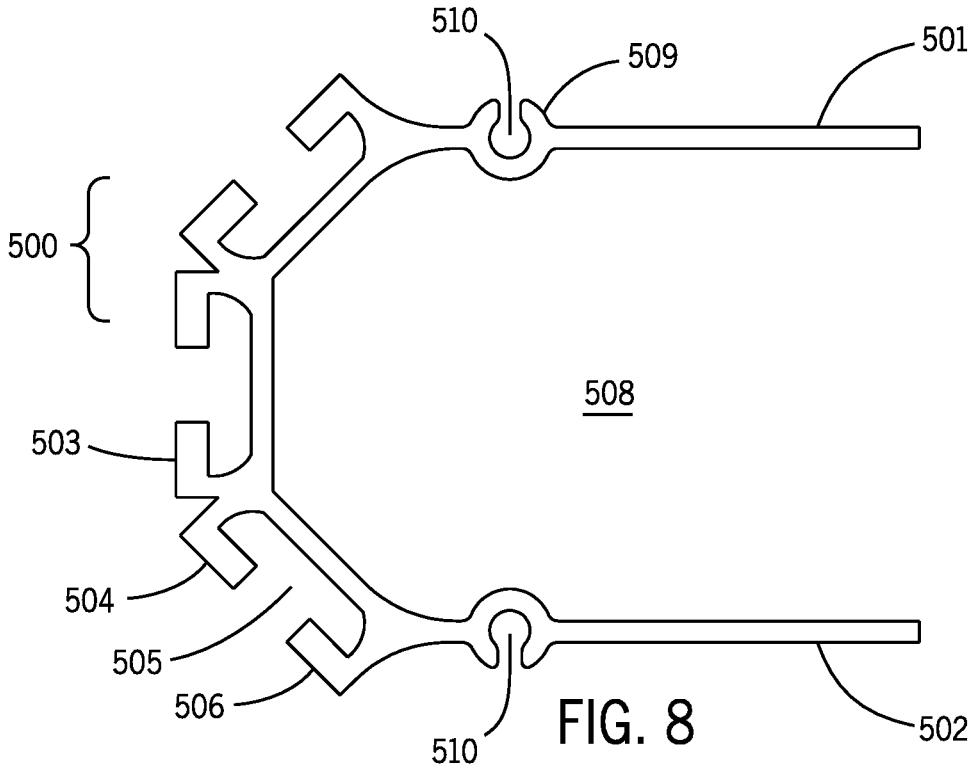
FIG. 8 illustrates a side view of the alternative clamp of FIG. 7.
Figure 9:
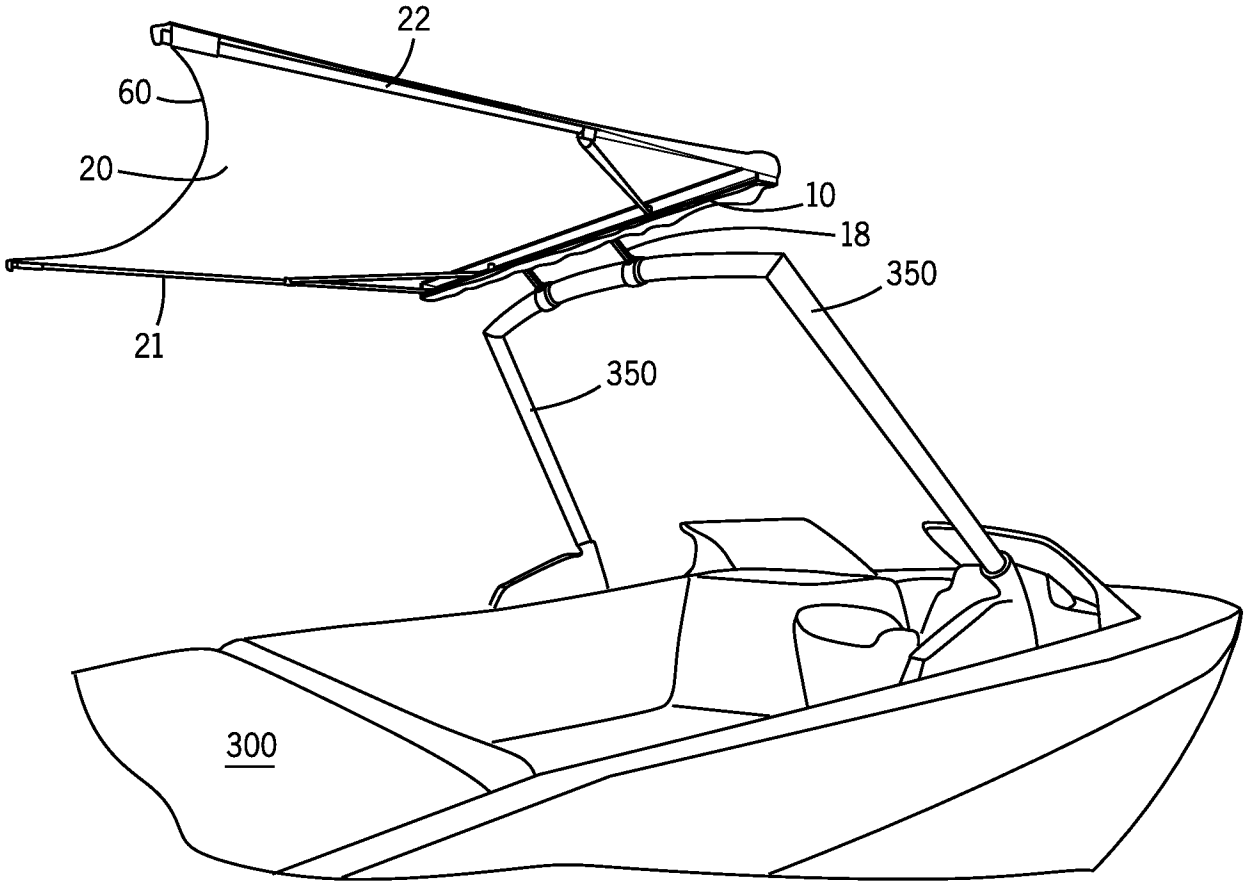
FIG. 9 illustrates the awning installed on the boat in the open orientation.
Figure 10:
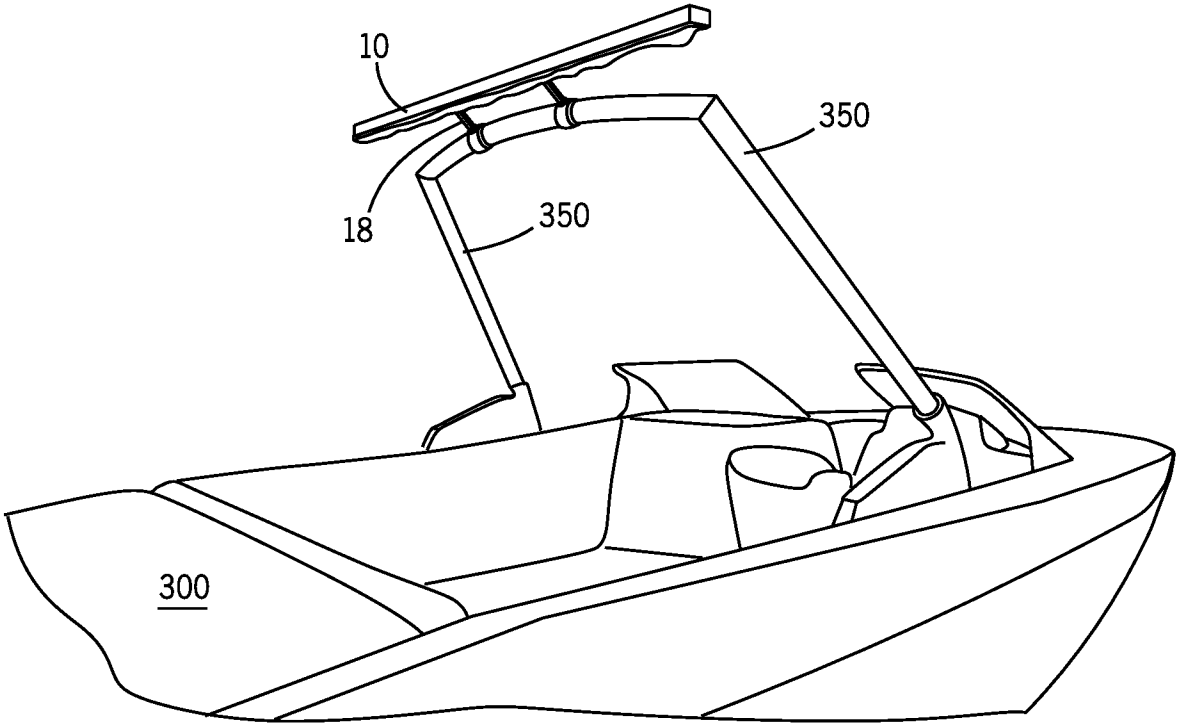
FIG. 10 illustrates the awning installed on the boat in the closed orientation.
Figure 11:
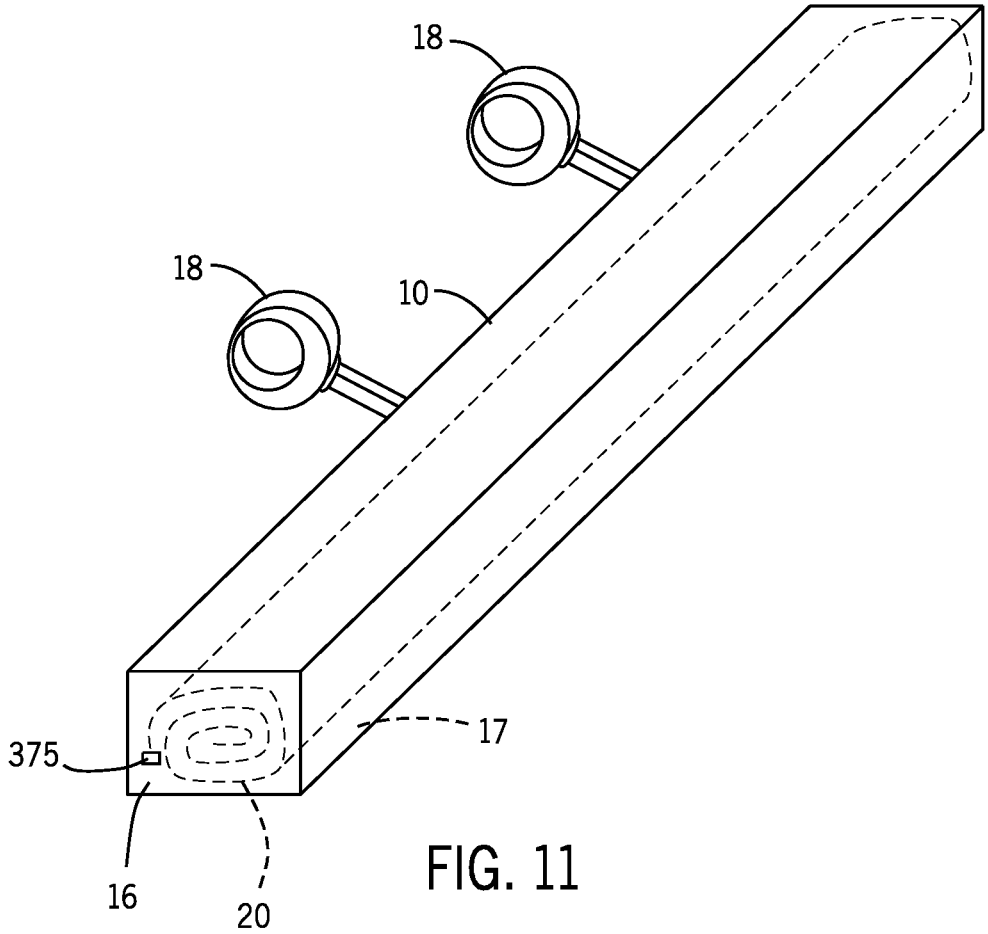
FIG. 11 illustrates a perspective view of the second side of the container wherein the fabric cover is rolled up and stored within the interior of the container. The cover is shown located within the interior of the container for illustrative purposes.

The retractable awning system 1 may be stored in a closed (or "first") orientation as shown in FIGS. 6, 10 and 11 when the awning 1 is not in use or the awning system 1 may be moved to the open (or "second") orientation best illustrated by FIGS. 1 and 9 when a user desires to use the awning system 1. In an embodiment, the back 14 of the securing container 10 may have a plurality of securing loops/clamps 18. The securing loops/clamps 18 (FIG. 1) may allow the awning system 1 to be attached to existing rods or "boat tower" 350 of a boat 300. The figures show the present retractable awning system 1 having two securing loops/clamps 18; however, a greater or fewer number of securing loops/clamps 18 may be used. Additionally, alternative securing mechanisms may be used to secure the present retractable awning system 1 to the boat 300 as illustrated in FIGS. 7 and 8 and discussed further below.

The securing container 10 may itself have a fabric cover 40 having a securing means 41. The fabric cover 40 is preferably secured to both the top 11 and the bottom 12 of the securing container 10 and temporarily covers the front 13 of the securing container 10 when the awning system 1 is not in use. The back 14 of the securing container 10 may be free from the fabric cover 40. The securing means 41 of the fabric cover 40 may be, for example, a zipper which runs the entire length of the fabric cover 40 so that the fabric cover 40 is essentially split into two separate units (a top unit and a bottom unit) when the securing mechanism 41 ("zipper") is unzipped. In the open (or unzipped) orientation as best shown in FIG. 3, the interior 17 of the securing container 10 is accessible.

In the closed orientation of FIG. 6 when the securing means 41 of the fabric cover 40 of the securing container 10 is zipped-up, the first locking bar 21, the second locking bar 22 and the awning 20 are safely stored within the interior 17 of the securing container 10. In an alternative embodiment, only the first locking bar 21 and the second locking bar 22 are stored within the interior 17 of the securing container 10 when the awning system 1 is not in use and the fabric awning 20 is stored elsewhere. In an embodiment, the first locking bar 21 and the second locking bar 22 are secured to the securing container 10 at one end and rotate at that end.

When a user wishes to use the awning system the user first unzips the fabric cover 40 of the securing container 10. Once the fabric cover 40 of the securing container 10 is unzipped and therefore split into the top and bottom units, a user may now attach the back end of the awning 20 to the same securing means 41 of the securing container 10 by using a zipper or other securing means 375 attached to the awning 20 to secure the awning 20 to the top unit of the fabric cover 40 when the fabric cover 40 is unzipped. Once the awning 20 is secured to the top unit 40A of the fabric cover 40, the user then rotates the first locking bar 21 approximately ninety degrees from being parallel to the securing container 10 (and located within the securing container 10) to being generally perpendicular with respect to the securing container 10 as shown in FIG. 1. The first locking bar 21 may rotate at a pivot joint 30. In an embodiment, a first support bar 26 is also rotated to provide additional support and stability to the first locking bar 21 during use. The support bar 26 rotates less than (preferably half the distance with respect to) the first locking bar 21. Preferably between forty and fifth degrees with respect to the locking bars 21, 22. The same process is repeated on the other side of the device 1 with the second locking bar 22 and a second support bar 27. In an embodiment, the support bars 26, 27 are attached to the securing container 10 at one end and attached to the locking bars 21, 22 and their other end.

Figure 5:
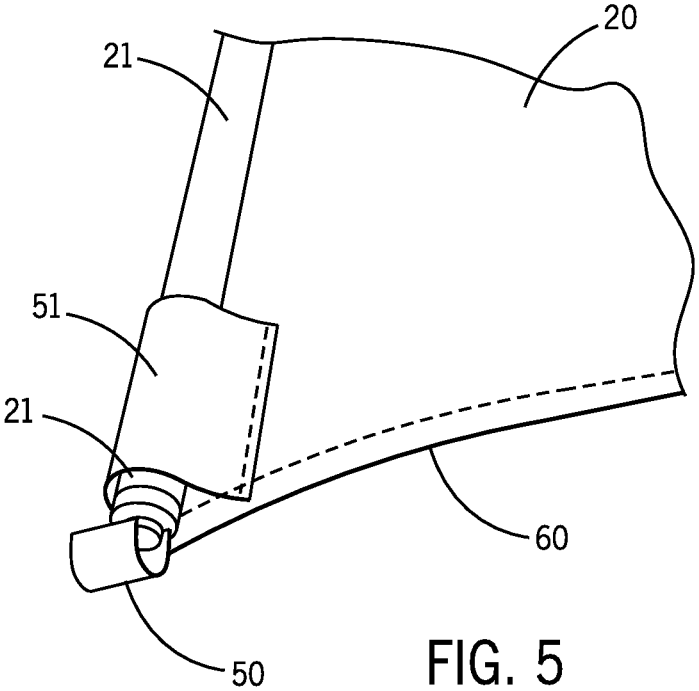
FIG. 5 illustrates a side view of the front end of the awning in the open orientation.

After the first locking bar 21 and the second locking bar 22 are rotated approximately ninety degrees (and are again parallel) each and are then perpendicular with respect to the securing container 10, the front 60 of the awning 20 may now be secured to the locking bars 21, 22 in a tight manner. Specifically, an end plug 50 (FIG. 5) of the front 60 of the awning 20 is inserted into an opening (not shown) located at the distal end of the first locking bar 21 so that the sides of the awning 20 are stretched to approximately the same length (often around four feet) as the length of the first locking bar 21 and the second locking bar 22. A securing strip 51 may additionally be wrapped around the first locking bar 21 and second locking bar 22. The securing strip 51 may be. For example, a hook and loop fastener system.

In an embodiment, the clamps/loops 18 may separate into two halves 18A, 18B and have two or four screws to connect both halves 18A, 18B. The clamps/loops 18 may be attached to the boat tower 350 on the top of the boat 300. The boat tower 350 at the top of the boat 300 is sometimes called the "bimini" tower. In an embodiment, an optional and removable rubber O-ring unit 425 (FIG. 1) fits inside the clamps/ loops 18 to protect the tower 350 of the boat 300 and further to allow the awning system 1 to be used in connection with different sized towers 350.

Referring now to FIGS. 7 and 8, in an alternative embodiment, the securing container 10 may be secured to the clamps/loops 18 by use of a stand-off brace 500. In this embodiment, the base of the clamps/loops 18 may slide into one of several opening slots 505 of the stand-off brace 500. The stand-off brace 500 may allow the user to slide the clamps/loops 18 into one of a plurality of openings 505 of the stand-off brace 500 so as to be able to adjust the angle of the device 1 with respect to the boat tower 350.

In an embodiment, the clamps/loops 18 of the stand-off brace 500 are secured to the boat tower 350. The stand-off brace 500 may be generally u-shaped having a front 503, a first side 501, a second side 502, an open back 518, a first end 530 and a second end 531 (defining its length). The open back 518 provides access to the interior 508 of the stand-off brace 500 so that the stand-off brace 500 may receive the securing container 10. Along the front 503 of the stand-off brace 500 may be at least two grasping units wherein each grasping units (combined as 504, 505 and 506) have a first extended ridge 504 and a second extended ridge 506 and an opening slot 505 located before the first extended ridge 504 and the second extended ridge 506. FIGS. 7 and 8 illustrates three grasping units, although a greater or fewer number of grasping units may be present on the stand-off brace 500.

In an embodiment, the bottom 19B of a shaft 19A of the clamps/loops 18 may slide into one of the grasping unit openings 505 of the stand-off brace 500 at the first end 530 or the second end 531 of the stand-off brace 500. The securing container 10 is secured to the back of the stand-off brace 10. A built-in spring 509 having an opening 510 on the first side 501 and the second side 502 of the stand-off brace 500 allows the stand-off brace 500 to be slightly flexible so as to properly receive and provide flexible support for both the clamps/loops 18 and the securing container 10.

Figure 12:
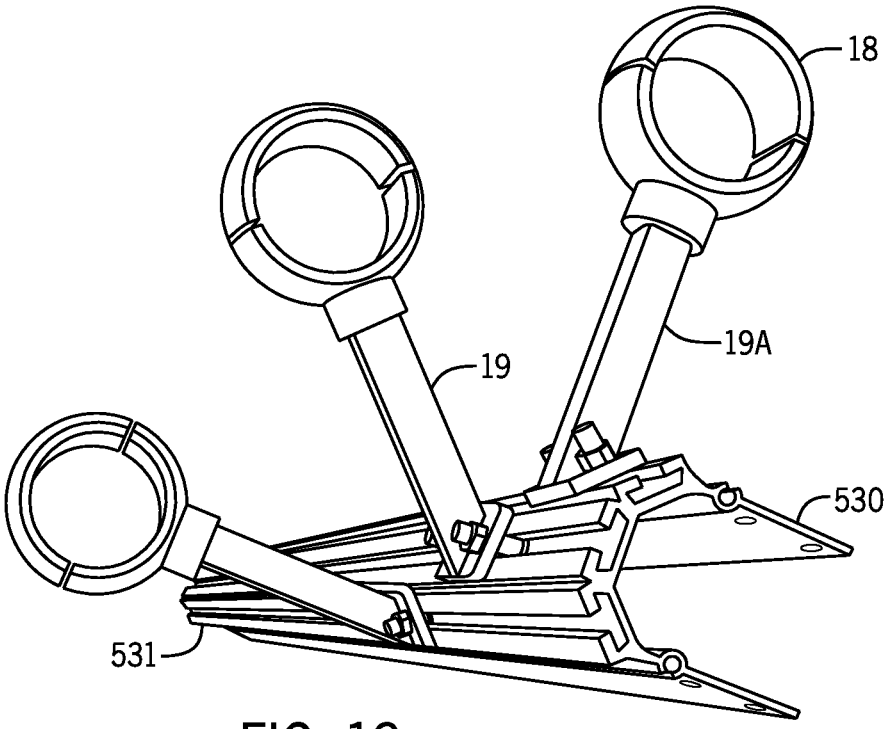
FIG. 12 illustrates a perspective view of an alternative stand-off brace of the awning wherein all three grasping units are occupied only for illustrative purposes.
Figure 13:
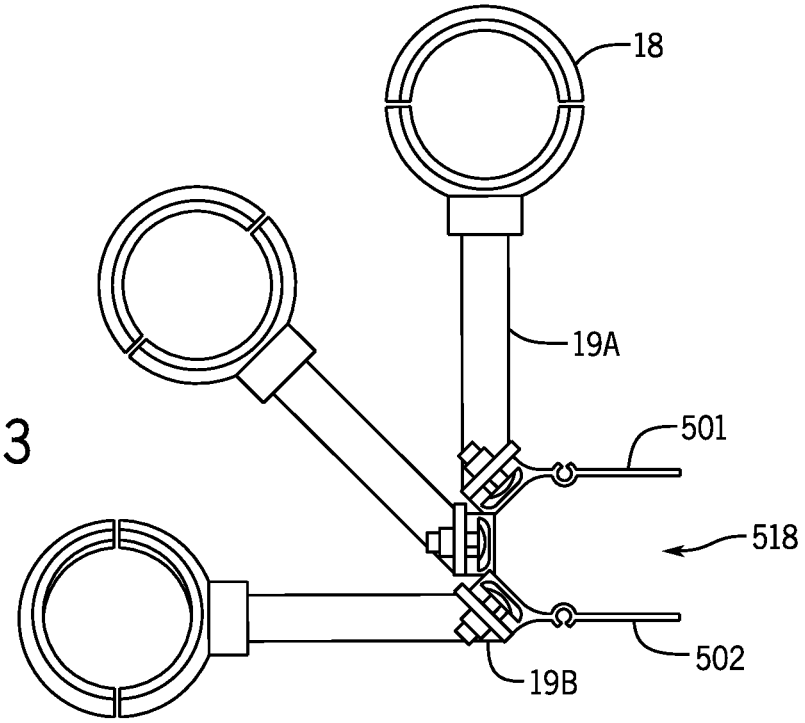
FIG. 13 illustrates a side view of the alternative stand-off brace of the awing wherein all three grasping units are occupied only for illustrative purposes.

FIGS. 12 and 13 illustrate three separate sets of clamps/loops 18 occupying each of the grasping units; however, it should be understood that, in use, only one of the grasping units of the stand-off brace 500 is used at a time. FIGS. 12 and 13 illustrate all the grasping units being used at the same time only for illustrative purposes to illustrate the potential angles of the clamps/loops 18 with respect to the tower 3650 of the boat 300.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. An awning system for a boat comprising:

a securing container housing have a first side, a second side, a front, a back, a top, a bottom and a generally hollow interior;

a securing mechanism for securing the securing container to a tower of a boat;

a first locking bar removably secured within the hollow interior of the securing container housing;

a second locking bar removably secured within the hollow interior of the securing container housing;

wherein the first locking bar rotates from a first position parallel to front of the securing container housing to a second position perpendicular with respect to the front of the securing container housing;

wherein the second locking bar rotates from a first position parallel to front of the securing container housing to a second position perpendicular with respect to the front of the securing container housing;

an awning attached to the first locking bar and the second locking bar when the first locking bar and the second locking bar are in the second position-;

a first support bar attached to the first locking bar and second support bar attached to the second locking bar wherein the first support bar and wherein the first support bar and the second support bar each rotate less degrees with respect to the securing container housing than the degrees of rotation of the first locking bar and the second locking bar with respect to the securing container housing.

2. The awning system for a boat of claim 1 wherein the awning is stored in the interior of the securing container in a first position and is removed from the interior of the securing container in a second position.

3. The awning system for a boat of claim 1 further comprising:

a cover attached to the top of the securing container wherein the cover partially covers the interior of the securing container in a first position and exposes the interior of the securing container in a second position.

4. The awning system for a boat of claim 3 further comprising:

a securing means attached to the cover wherein the securing means removably attaches to a back of the awning.

5. The awning system for a boat of claim 3 wherein the cover is made of a fabric.

6. The awning system for a boat of claim 1 further comprising:

a brace unit located between the tower of the boat and a clamp wherein the brace unit receives and secures the back end of the securing container.

7. The awning system for a boat of claim 6 further comprising:

a plurality of opening slots located on the brace unit wherein the plurality of opening slots of the brace unit may each may receive a clamp which is secured to the tower of the boat.

8. The awning system for a boat of claim 7 wherein the plurality of opening slots extend from a first end of the brace unit to a second end of the brace unit and wherein the clamp may slide through the opening slot and may be secured in the opening slot.

9. The awning system for a boat of claim 7 wherein the opening slots of the brace unit are at different angles with respect to a first side of the brace unit.

10. The the awning system for a boat of claim 6 wherein the brace unit has at least one built in spring mechanism wherein the spring mechanism allows a first side of the brace unit to move with respect to a second side of the brace unit.

11. The awning system for a boat of claim 1 wherein the first locking bar, the second locking bar and the awning are secured within the interior of the securing container.

12. The awning system for a boat of claim 1 wherein the securing container is made of aluminum.

13. The awning system for a boat of claim 1 wherein the first support bar and the second support bar rotate one-half the degrees as the first locking bar and the second locking bar respectively.

14. The awning system for a boat of claim 1 further comprising:

a first end plug at a front of the awning wherein the first end plug receives and secures an end of the first locking bar and a second end plug at the front of the awning wherein the second end plug receives and secures an end of the second locking bar.

15. An awning system for a boat comprising:

a securing container housing have a first side, a second side, a front, a back, a top, a bottom and a generally hollow interior;

a securing mechanism for securing the securing container to a tower of a boat;

a first locking bar removably secured within the hollow interior of the securing container housing;

a second locking bar removably secured within the hollow interior of the securing container housing;

wherein the first locking bar rotates from a first position parallel to front of the securing container housing to a second position perpendicular with respect to the front of the securing container housing;

wherein the second locking bar rotates from a first position parallel to front of the securing container housing to a second position perpendicular with respect to the front of the securing container housing;

an awning attached to the first locking bar and the second locking bar when the first locking bar and the second locking bar are in the second position; and a first support bar attached to the first locking bar and second support bar attached to the second locking bar.

16. An awning system for a boat comprising:

a securing container housing have a first side, a second side, a front, a back, a top, a bottom and a generally hollow interior;

a securing mechanism for securing the securing container to a tower of a boat;

a first locking bar removably secured within the hollow interior of the securing container housing;

a second locking bar removably secured within the hollow interior of the securing container housing;

wherein the first locking bar rotates from a first position parallel to front of the securing container housing to a second position perpendicular with respect to the front of the securing container housing;

wherein the second locking bar rotates from a first position parallel to front of the securing container housing to a second position perpendicular with respect to the front of the securing container housing;

an awning attached to the first locking bar and the second locking bar when the first locking bar and the second locking bar are in the second position; and a cover attached to the top of the securing container wherein the cover partially covers the interior of the securing container in a first position and exposes the interior of the securing container in a second position.

17. The awning system for a boat of claim 16 further comprising:

a securing means attached to the cover wherein the securing means removably attaches to a back of the awning.

18. The awning system for a boat of claim 16 wherein the cover is made of a fabric.

19. An awning system for a boat comprising:

a securing container housing have a first side, a second side, a front, a back, a top, a bottom and a generally hollow interior;

a securing mechanism for securing the securing container to a tower of a boat;

a first locking bar removably secured within the hollow interior of the securing container housing;

a second locking bar removably secured within the hollow interior of the securing container housing;

wherein the first locking bar rotates from a first position parallel to front of the securing container housing to a second position perpendicular with respect to the front of the securing container housing;

wherein the second locking bar rotates from a first position parallel to front of the securing container housing to a second position perpendicular with respect to the front of the securing container housing;

an awning attached to the first locking bar and the second locking bar when the first locking bar and the second locking bar are in the second position;

a brace unit located between the tower of the boat and a clamp wherein the brace unit receives and secures the back end of the securing container; and a plurality of opening slots located on the brace unit wherein the plurality of opening slots of the brace unit may each may receive a clamp which is secured to the tower of the boat.

20. The awning system for a boat of claim 19 wherein the plurality of opening slots extend from a first end of the brace unit to a second end of the brace unit and wherein the clamp may slide through the opening slot and may be secured in the opening slot.

21. The awning system for a boat of claim 19 wherein the opening slots of the brace unit are at different angles with respect to a first side of the brace unit.

22. An awning system for a boat comprising:

a securing container housing have a first side, a second side, a front, a back, a top, a bottom and a generally hollow interior;

a securing mechanism for securing the securing container to a tower of a boat;

a first locking bar removably secured within the hollow interior of the securing container housing;

a second locking bar removably secured within the hollow interior of the securing container housing;

wherein the first locking bar rotates from a first position parallel to front of the securing container housing to a second position perpendicular with respect to the front of the securing container housing;

wherein the second locking bar rotates from a first position parallel to front of the securing container housing to a second position perpendicular with respect to the front of the securing container housing;

an awning attached to the first locking bar and the second locking bar when the first locking bar and the second locking bar are in the second position;

a brace unit located between the tower of the boat and a clamp wherein the brace unit receives and secures the back end of the securing container; and wherein the brace unit has at least one built in spring mechanism wherein the spring mechanism allows a first side of the brace unit to move with respect to a second side of the brace unit.

23. The awning system for a boat of claim 15 wherein the first support bar and the second support bar rotate one-half the degrees as the first locking bar and the second locking bar respectively.

24. An awning system for a boat comprising:

a securing container housing have a first side, a second side, a front, a back, a top, a bottom and a generally hollow interior;

a securing mechanism for securing the securing container to a tower of a boat;

a first locking bar removably secured within the hollow interior of the securing container housing;

a second locking bar removably secured within the hollow interior of the securing container housing;

wherein the first locking bar rotates from a first position parallel to front of the securing container housing to a second position perpendicular with respect to the front of the securing container housing;

wherein the second locking bar rotates from a first position parallel to front of the securing container housing to a second position perpendicular with respect to the front of the securing container housing;

an awning attached to the first locking bar and the second locking bar when the first locking bar and the second locking bar are in the second position; and a first end plug at a front of the awning wherein the first end plug receives and secures an end of the first locking bar and a second end plug at the front of the awning wherein the second end plug receives and secures an end of the second locking bar.

* * * * *